US005735467A

United States Patent [19]

Lee

[11] Patent Number: 5,735,467

[45] Date of Patent: Apr. 7, 1998

[54] THREE-WAY ADJUSTABLE SHOWER DEVICE

[76] Inventor: Cheng-Chung Lee, 5F., No. 11-6, Alley 4, Lane 63, Yi Li St., Pei Tou District, Taipei, Taiwan

[21] Appl. No.: 708,622

[22] Filed: Sep. 5, 1996

[51] Int. Cl.[6] ..... A62C 31/00; B05B 15/00; F23D 11/38

[52] U.S. Cl. ..... 239/414; 239/107; 239/447

[58] Field of Search ..... 239/107, 398, 239/407, 413, 414, 443, 444, 446, 447, 569

[56] References Cited

U.S. PATENT DOCUMENTS

| | | | |
|---|---|---|---|
| 4,394,969 | 7/1983 | Jette | 239/414 |
| 4,398,668 | 8/1983 | Jette | 239/414 |
| 4,629,124 | 12/1986 | Gruber | 239/447 X |
| 5,145,114 | 9/1992 | Monch | 239/447 X |
| 5,205,490 | 4/1993 | Steinhardt et al. | 239/447 X |
| 5,215,254 | 6/1993 | Haruch | 239/107 |

*Primary Examiner*—Andres Kashnikow
*Assistant Examiner*—Robin O. Evans
*Attorney, Agent, or Firm*—Pro-Techtor International

[57] ABSTRACT

A three-way adjustable shower device which can control the water flow rate and temperature includes a shower body , an adjustable valve, a spring valve means, a hose means and a dual pipe elbow. The dual pipe elbow connects with a hot and a cold water pipe for water inlet. The hose means has dual flow passage connecting with the dual pipe elbow at one end and connecting with the shower body at another end. The adjustable valve may be turned to various positions so that water of different flow rate and temperature may be selected to flow into the shower body. The spring valve means may be selected to give water outlet in either spouting, flushing or spraying fashion. (FIG. 1).

6 Claims, 9 Drawing Sheets

THREE-WAY ADJUSTABLE SHOWER DEVICE

BACKGROUND OF THE INVENTION

1. Field of the Invention

This invention relates to an adjustable shower device and particularly to shower head which can offer a variety of adjustable functions including controlling hot and cold water supply and offering water outlet in either spouting, flushing or spraying fashion.

2. Description of the Prior Art

Conventional shower head usually needs a faucet to control and adjust the water temperature and flow rate. It has the following disadvantages;

a. It usually takes a user a lot of trial to adjust the faucet before getting the desired water temperature and flow.
b. There is usually some distance between the hot water supply and the shower head. It takes relative long time before reaching a desirable and stable water temperature. A user usually takes a shower intermittently which makes adjusting water temperature even more troublesome.
c. In multi-unit housing or in a house with more than one user taking shower at the same time, the water outlet pressure from the shared water tank fluctuates which makes adjusting water temperature difficult.
d. In light of the above, the repetitive adjusting of the faucet tends to cause a lot of water and fuel waste. Moreover, users are subject to harm owing to the stimulation in eyes.
e. A shower head usually can only provide water spraying function. It is not desirable when a user wants it for other use, such as cleansing, flushing, etc. Although some shower head can provide more then one form of water spouting, a user usually needs two hands to make the adjustment, and thus is not convenient.

There have been a number of prior arts being disclosed for improving the aforesaid disadvantages, however they mostly can offer only partial improvement. For instance, Taiwan (R. O. C.) Pat. Publication Numbers, 273289, 263035, 236180, 226576, 269167, 232807, 231569, and 254102 are some of them. And still, U.S. Pat. Nos. 5,402,812, 5,427,318, 4,629,124, 3,637,143, 3,542,331, 2,789,011. There are still rooms for improvement.

SUMMARY OF THE INVENTION

It is therefore an object of the present invention to provide an adjustable functions and features, including water flow rate control, water temperature adjustment and three-way water outlet selection (i.e. spraying, spouting and flushing).

It is another object of the present invention to provide an adjustable shower device which is easy to use and enable a user to do the desired adjustment single-handed without a lot of trial. It is a further object of this invention to provide an adjustable shower head which can be easily and effectively used, and thus can reduce water waste and save energy for water heating.

In order to achieve the aforesaid objects, the present invention uses a flexible hose with dual flow passage inside to connect at one end with a dual pipe elbow for hot and cold water supply and to connect at another end with an adjustable shower head. The adjustable shower head has an adjusting cell and an adjusting stud for adjusting water temperature flow rate to a desired degree. It also has a water collection cell and a spring valve means for controlling the water outlet fashion.

Additional objects and advantages of the present invention are made apparent in the following description having referance to the accompanying drawing. The accompanying drawings are only to serve for reference and illustrative purpose, and do not intend to limit the scope of the present invention.

| | | | |
|---|---|---|---|
| 1 | shower body | 15 | water collecting cell |
| 10 | a shower arm | 16 | button hole |
| 11 | a shower head | 17 | water outlet |
| 12 | an adjusting cell | 18 | dual flow passage |
| 13 | an adjusting opening | 19 | a screwing neck |
| 14 | a screw opening | 2 | an adjusting valve |
| 20 | a water passage | 71 | nozzle studs |
| 21 | a pushing stud | 72 | nozzle apertures |
| 22 | a valve washer | 73 | a nozzle ring |
| 3 | an assembly cap | 74 | a nozzle barrel |
| 30 | a bulge | 8 | a spray cap |
| 31 | screw threads | 80 | screw threads |
| 32 | a cap washer | 81 | nozzle hooks |
| 4 | a retaining ring | 82 | cap studs |
| 40 | ring washer | 83 | a nozzle spring |
| 41 | ring rods | 84 | nozzle slots |
| 42 | ring slots | 85 | a spray cap washer |
| 43 | ring spring | 86 | outlet washer |
| 44 | ring hooks | 87 | spray slot |
| 5 | a flush barrel | 9 | a dual pipe elbow |
| 50 | a barrel washer | 90 | tightening rings |
| 51 | barrel apertures | 91 | tightening heads |
| 52 | a spacaed ring apertures | 92 | elbow washers |
| 53 | barrel studs | 93 | elbow inlets |
| 54 | barrel opening | 94 | an elbow outlet |
| 55 | barrel neck | 95 | a shower head seat |
| 56 | hook | 0 | a hose means |
| 57 | flush slot | 00 | twin hole ring |
| 58 | flush opening | 01 | a twin hole |
| 6 | a push button flange | 02 | a connecting neck |
| 60 | push button head | 03 | hose sleeves |
| 61 | button apertures | 04 | dual pipe washers |
| 62 | a push button washer | 05 | a flexible dual pipe hose |
| 7 | a nozzle | 100 | a spring valve means |
| 70 | flow outlet | 200 | a wheel valve cell |
| 201 | wheel valve openings | 208 | a water passage |
| 202 | a spindle slot | 209 | a spindle |
| 203 | wheel stopper | 210 | a friction trace |
| 204,205 | a half wheel stopper | 211 | a wheel valve |
| 206 | a mesh cap | 212 | a half wheel valve |
| 207 | a wheel valve washer | 213 | a concave notch |

DETAILED DESCRIPTION OF THE PREFERRED EMBODIMENT

Figure 1:
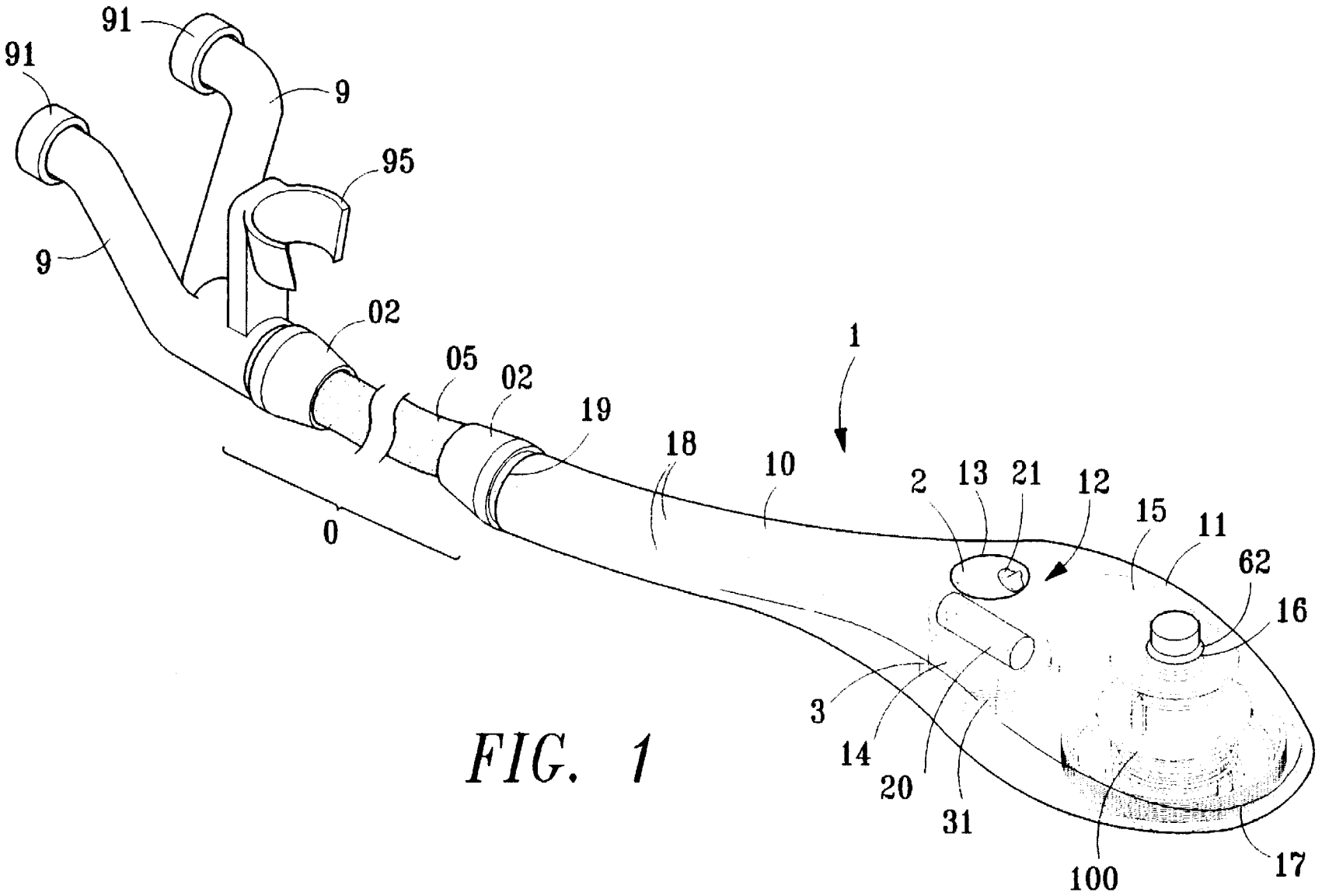
FIG. 1. is a perspective view of the present invention.
Figure 2:
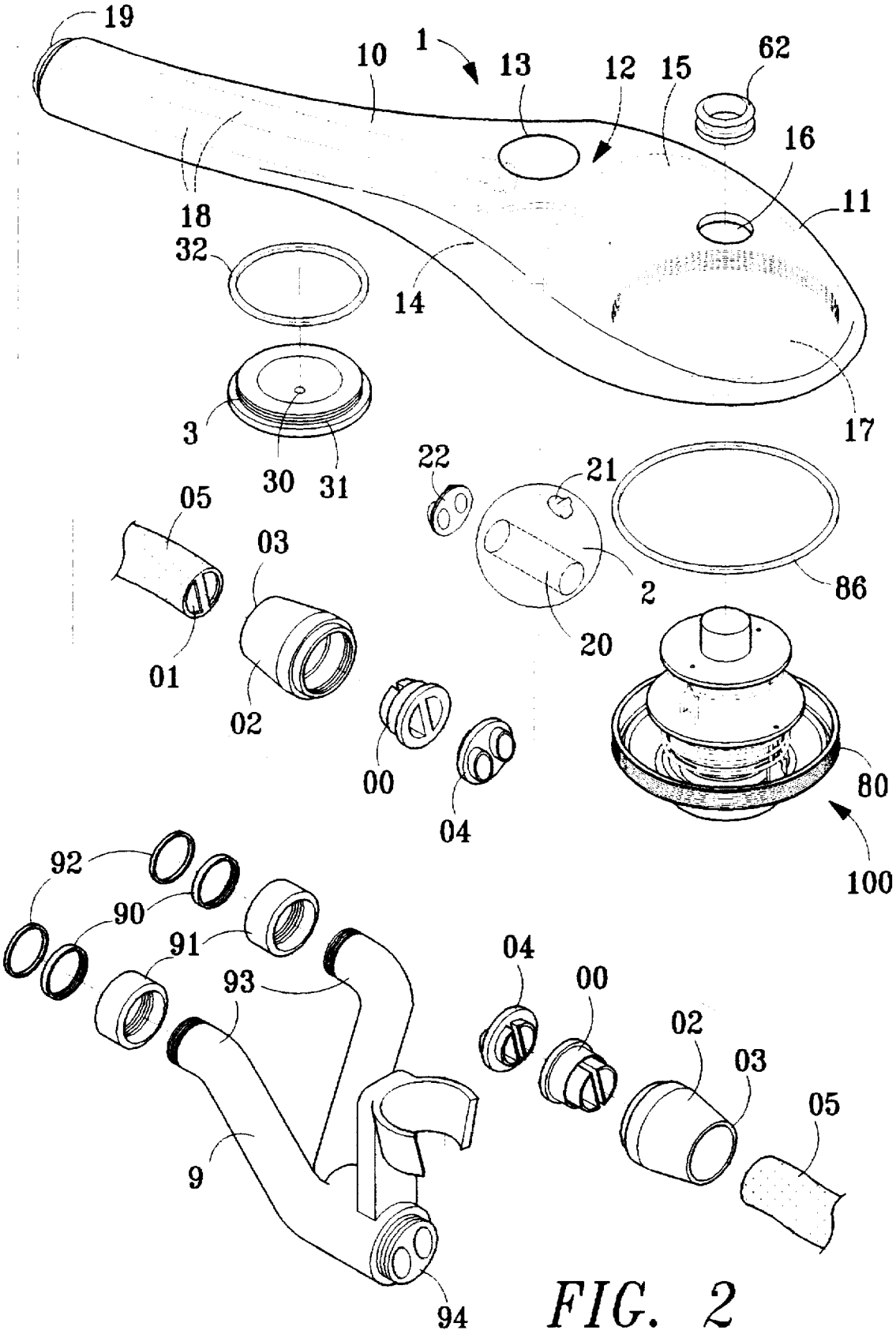
FIG. 2. is an exploded view of the present invention.

Referring to FIGS. 1 and 2, the present invention includes a shower body 1, an adjusting valve 2, an assemble cap 3, a dual pipe elbow 9, a hose means 0, and a spring valve means 100. The dual pipe elbow 9 has an elbow outlet 94 and a shower head seat 95 for holding a connecting neck 02 at one end, and has at another end two tightening heads 91 screwed respectively with two elbow inlets 93, then through two tightening rings 90 and two elbow washers 92 connect respectively with cold and hot water supply.

The elbow outlet 94 connects with a hose means 0 which includes a pair of a connecting necks 02, a pair of hose sleeves 03, a flexible dual pipe hose 05, a twin hole 01 , a pair of twin hole ring 00 and a pair of dual pipe washers 04. The other end of the hose means 0 connects with a screwing neck 19 of a shower arm 10 which has dual flow passage 18 located inside for hot and cold water to flow therethrough respectively.

The dual flow passage 18 leads to an adjusting cell 12 located in the shower head 11. The adjusting cell 12 has an adjusting opening 13 on the top and a screw opening 14 at the bottom.

Inside the adjusting cell 12, there is an adjusting valve 2 which has a pushing stud 21 on the top, a water passage 20 and a valve washer 22 at one end connecting with one end of the dual flow passage 18. The adjusting valve 2 is supported by an assembly cap 3 which includes a cap washer 32, a bulge 30 for reducing the moving resistance of the adjusting valve 2 and screw threads 31 for engaging with the screw opening14 tightly. By moving the pushing stud 21, the valve 2 can be moved up or down, left or right.

Figure 4E:
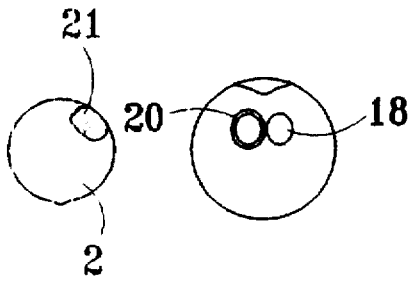
FIG. 4A to 4E show various positions of an adjusting valve.
Figure 4D:
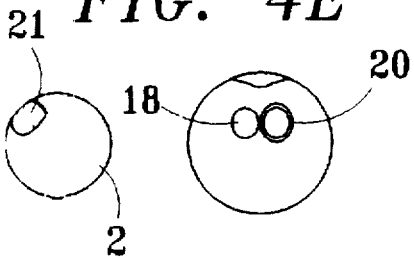
Figure 4C:
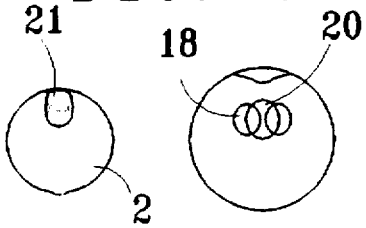
Figure 4B:
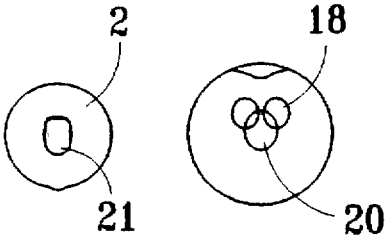
Figure 4A:
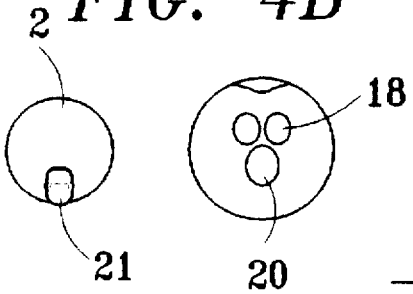
Figure 3A:
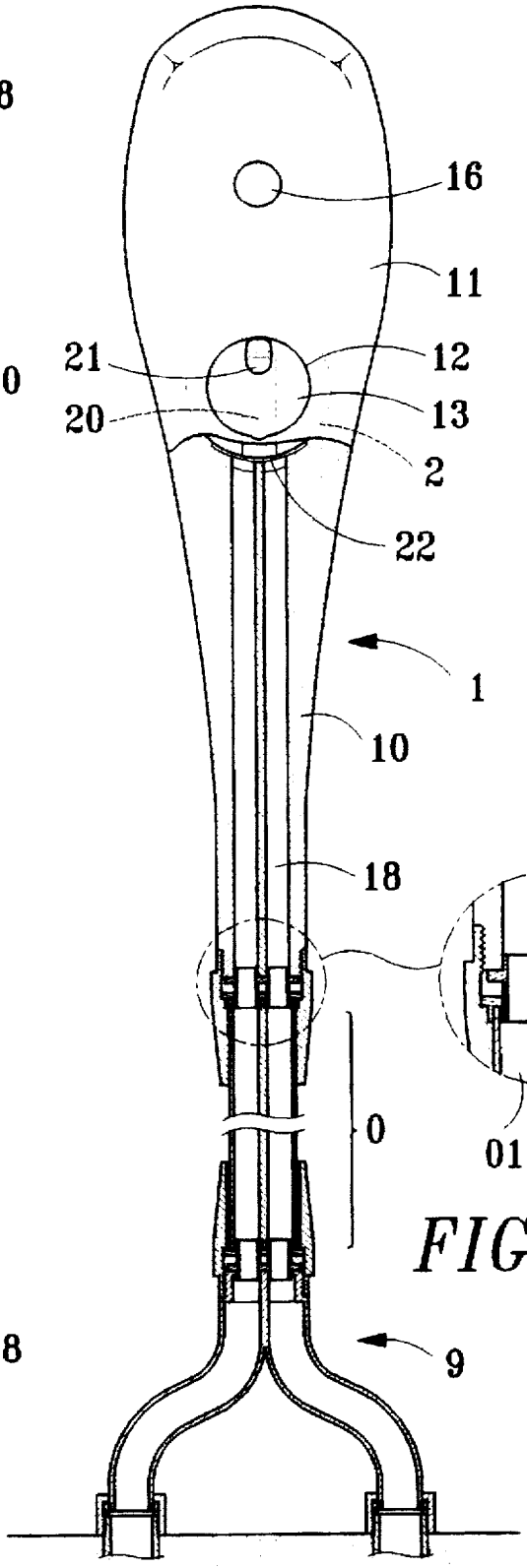
FIG. 3. is a top view, partly cutaway, of a dual flow passage of the present invention.
Figure 3B:
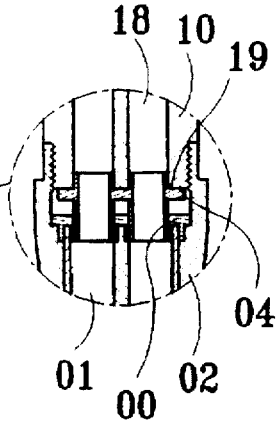

Therefore the opening of the water passage 20 can be aligned with the dual flow passage 18 in various positions to adjust water flow and temperature. FIGS. 4D and 4E show only hot or cold water is allowed to pass. FIGS. 4B and 4C show both hot and cold water is allowed to enter. Different water temperature may be adjusted as desired. FIG. 4A shows that water flow is cut off. Then water is leaving the adjusting valve 2 and flows into a water collecting cell 15 located in the shower head 11 for adjusting water outlet fashion.

Figures 10, 11A, 11B:
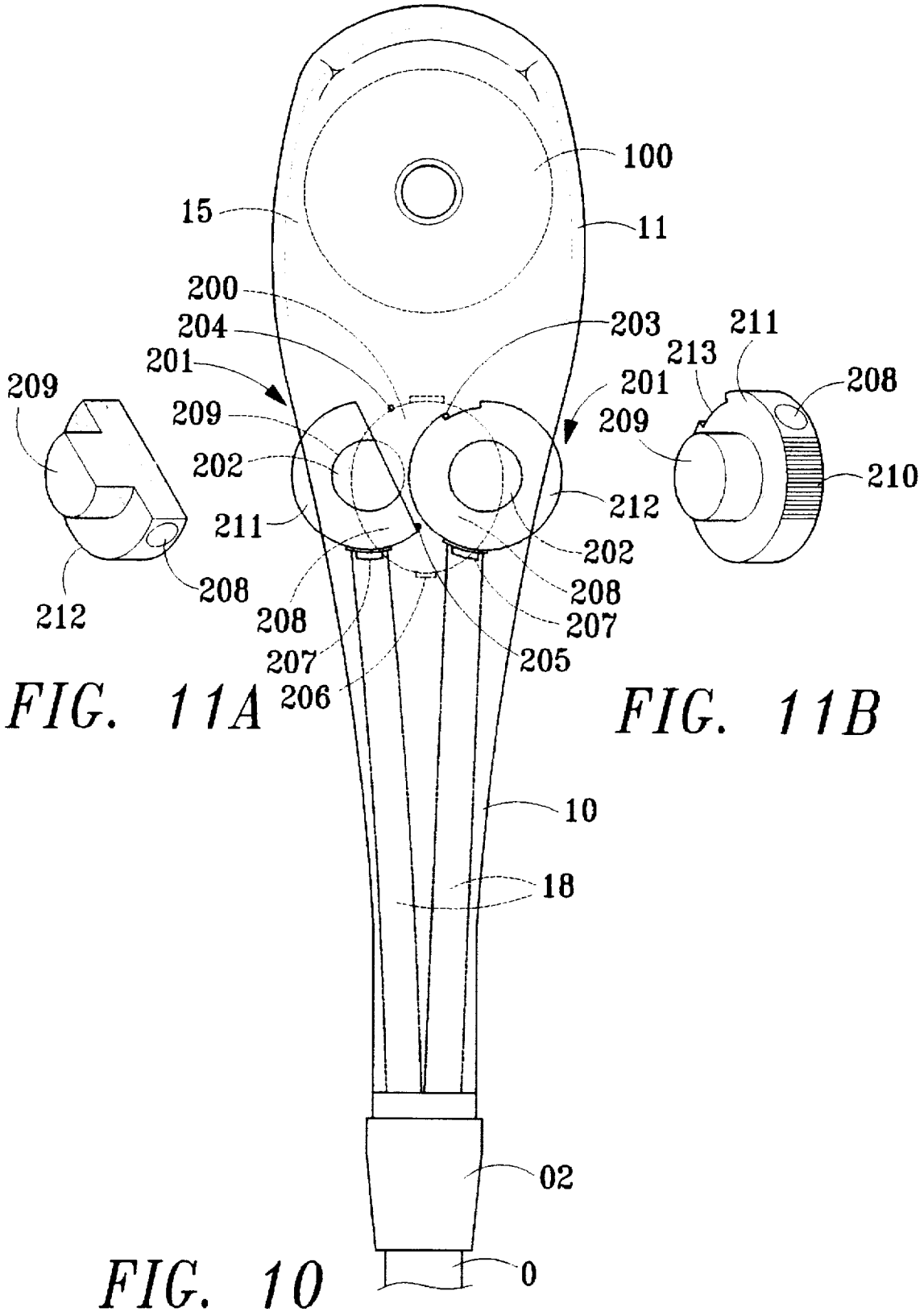
FIG. 10. is a top view of another of the present invention.
FIG. 11A and 11B are perspective views of a wheel valve and a half wheel valve of another embodiment.

FIGS. 10.11A and 11B show another embodiment of water flow and temperature adjustment means. Instead of an adjusting cell 12, there is a wheel valve cell 200 in its place. The wheel valve cell 200 has two wheel valve openings 201 run through the side walls of the shower head. In the wheel valve cell 200, there are three wheel stoppers 203, 204, 205 and a mesh cap 206. There is a wheel valve 211 disposed at one side of the wheel valve cell 200. The wheel valve 211 has a water passage 208 inside, a concave notch 213 and a friction trace 210 formed on the circumference. There is a spindle 209 runs through a spindle slot 202 formed on the top inside of the shower head. There is a half wheel valve 212 located on another side of the wheel valve cell. The half wheel valve 212 also has a water passage 208 and a spindle 209 running through another spindle slot 202. The water passages 208 may have fluid communication with the dual flow passage 18, with a wheel valve washer 207 set between them to prevent water leakage. The concave notch 213 is engageable with the wheel stopper 203 and thus enable the wheel valve 211 to rotate within the two ends of the concave notch 213. The half wheel valve 212 is rotatable within the range of the stoppers 204 and 205. Therefore through the friction trace 210, the wheel valve 211 and half wheel valve 212 may be turned to align the water passage 208 against the dual flow passage 18. Consequently different flow rate of hot and cold water may be allowed to flow into the water collecting cell 15.

Referring to FIG. 2 the water collecting cell 15 has a button hole 16 on the top of the shower head 11 and a water outlet 17 at the bottom. A spring valve means 100 is screwed into the water outlet 17 with an outlet washer 86 set between them.

Figure 5:
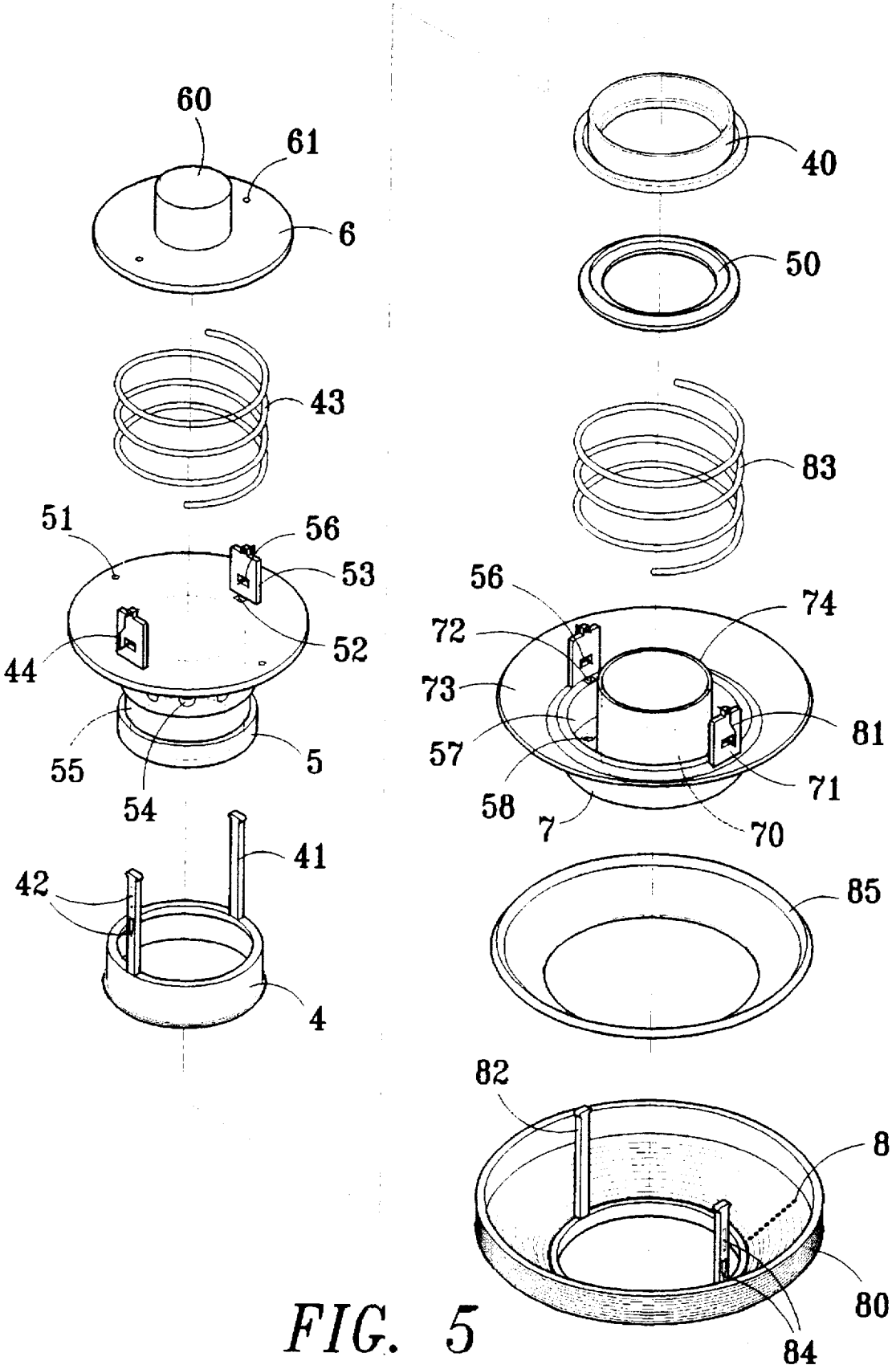
FIG. 5. is an exploded view of spring valve means.
Figure 6:
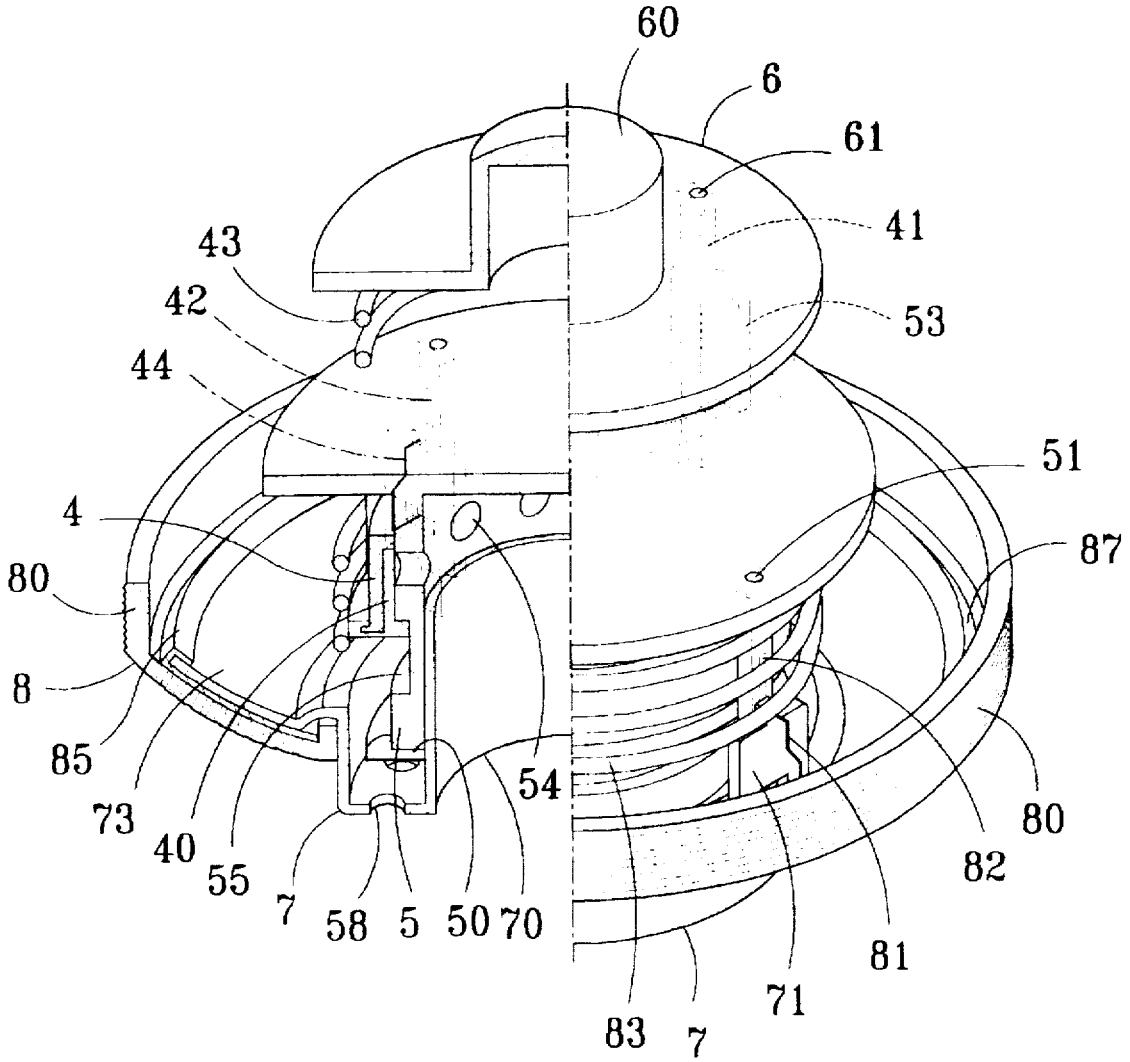
FIG. 6. is a perspective view, partly cutaway, of a spring valve means.

Referring to FIG. 5 and 6, the spring valve means 100 includes a retaining ring 4, a flush barrel 5, a push button flange 6, a nozzle 7, a spray cap 8, two springs 43 and 83, a pair of twin hooks 44 and 81, three washers 40, 50 and 85. The ring washer 40 locates at the bottom of the retaining ring 4 which has a pair of ring rods 41 run through a space ring apertures 52 formed adjacent a pair of barrel studs 53 on the flush barrel 5. The inside rim of the ring washer 40 contacts the barrel neck 55. The ring spring 43 surrounds the ring rods 41 and the barrel studs 53. The top ends of the ring rods 41 then engage with a pair of button apertures 61 located in the push button flange 6. The bottom of the flush barrel 5 has a barrel washer 50. The nozzle 7 has a pair of nozzle studs 71 each has a nozzle aperture 72 formed nearby for engaging with a pair of cap studs 82 located on the spray cap 8. A nozzle spring 83 surrounds the cap studs 82 and nozzle studs 71. A spray cap washer 85 is engaged with a nozzle ring 73 of the nozzle 7. The cap studs 82 engage with a pair of barrel apertures 51, therefore making the flush barrel 5 engaging with a nozzle barrel 74 of the nozzle. The ring spring 43 is then compressed against the push button flange 6. The ring hooks 44 run through the hook apertures 56 of the barrel stud 53, then engage with the ring slots 42, and finally release the ring spring 43.

The nozzle spring 83 compresses against the barrel apertures 51. The nozzle hooks 81 run through the hook apertures 56 and engage with the nozzle slots 84, and then release the nozzle spring 83. Thus complete the assembly of the spring valve means 100.

Now referring to FIG. 2, the spring valve means 100 is screwed into the water outlet 17 through screw threads 80 from under with the outlet washer 86 set between them, and a push button washer 62 is disposed in the button hole 16.

Figure 7:
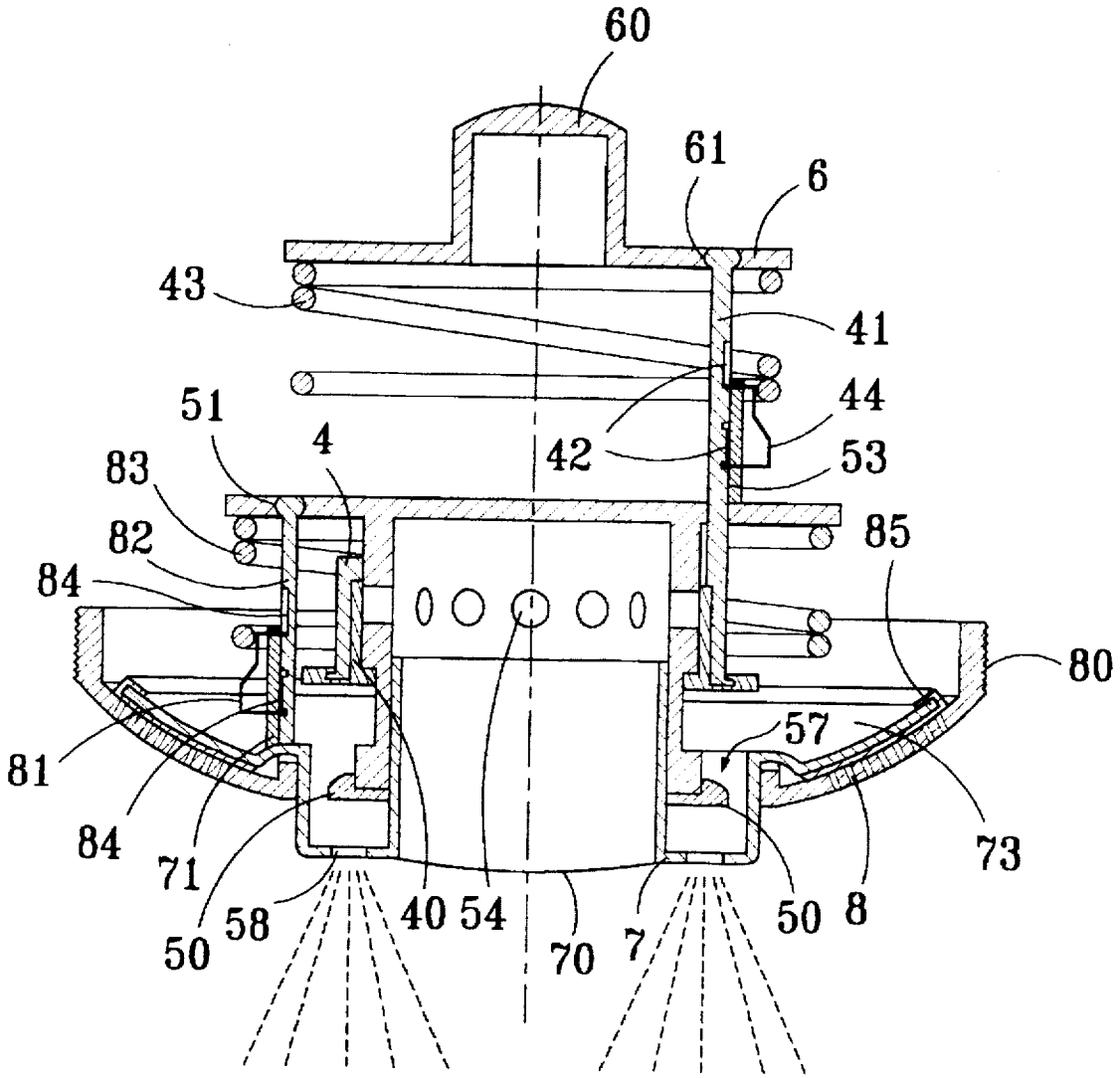
FIG. 7. is a spring valve means operation state for spouting.

Referring to FIG. 7 for the present invention in use for spouting. Upon repetitive pressing the push button head 60, the ring spring 43 forces the ring hooks 44 to engage with the ring slots 42. The barrel opening 54 and flush slot 57 are blocked by the ring washer 40. Water thus flows out through flush opening 58.

Figure 8:
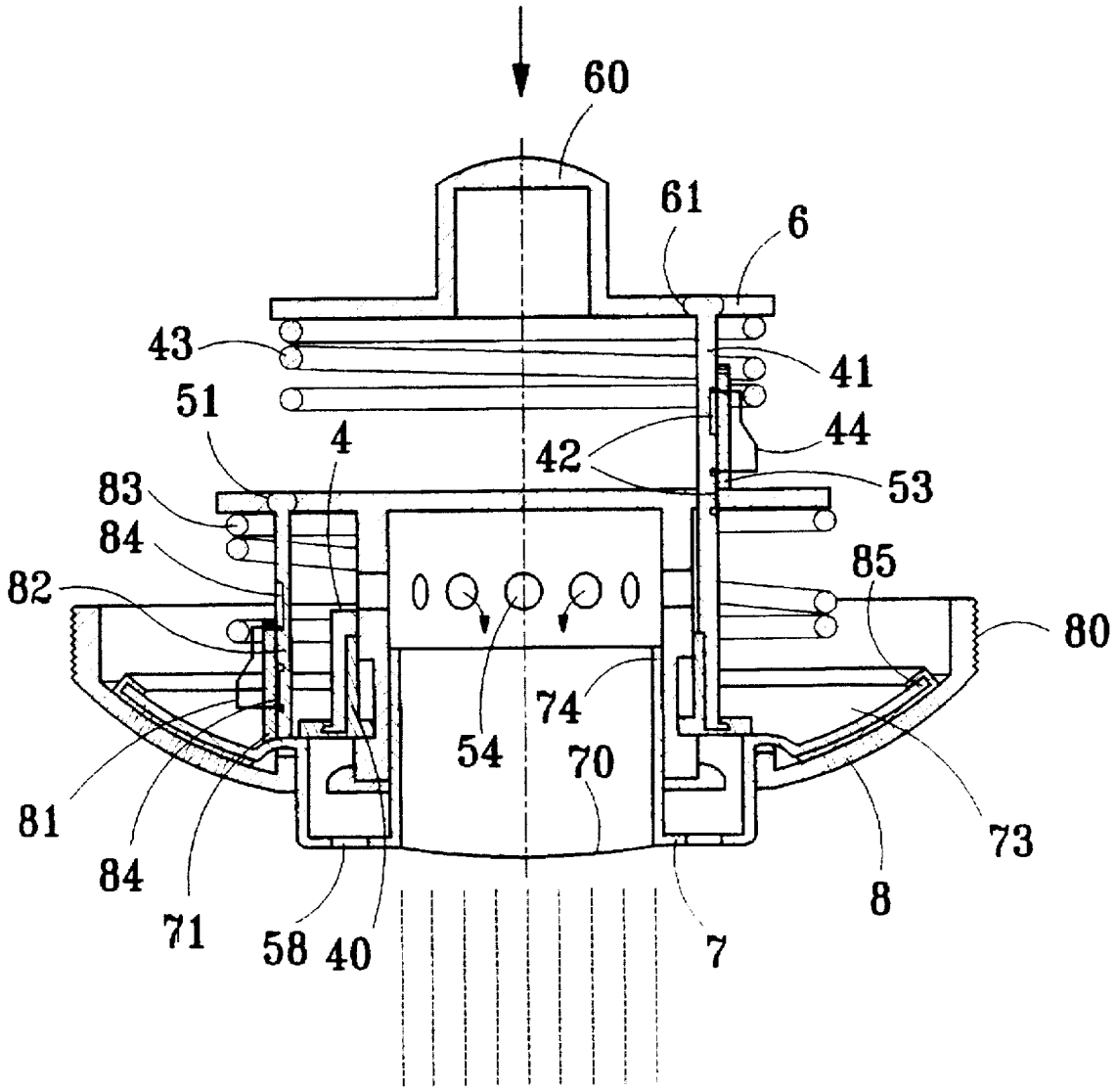
FIG. 8. is a spring valve means operation state for flushing.

In FIG. 8, water flows from the barrel opening 54 into the nozzle barrel 74 then flush out through flow outlet 70.

Figure 9:
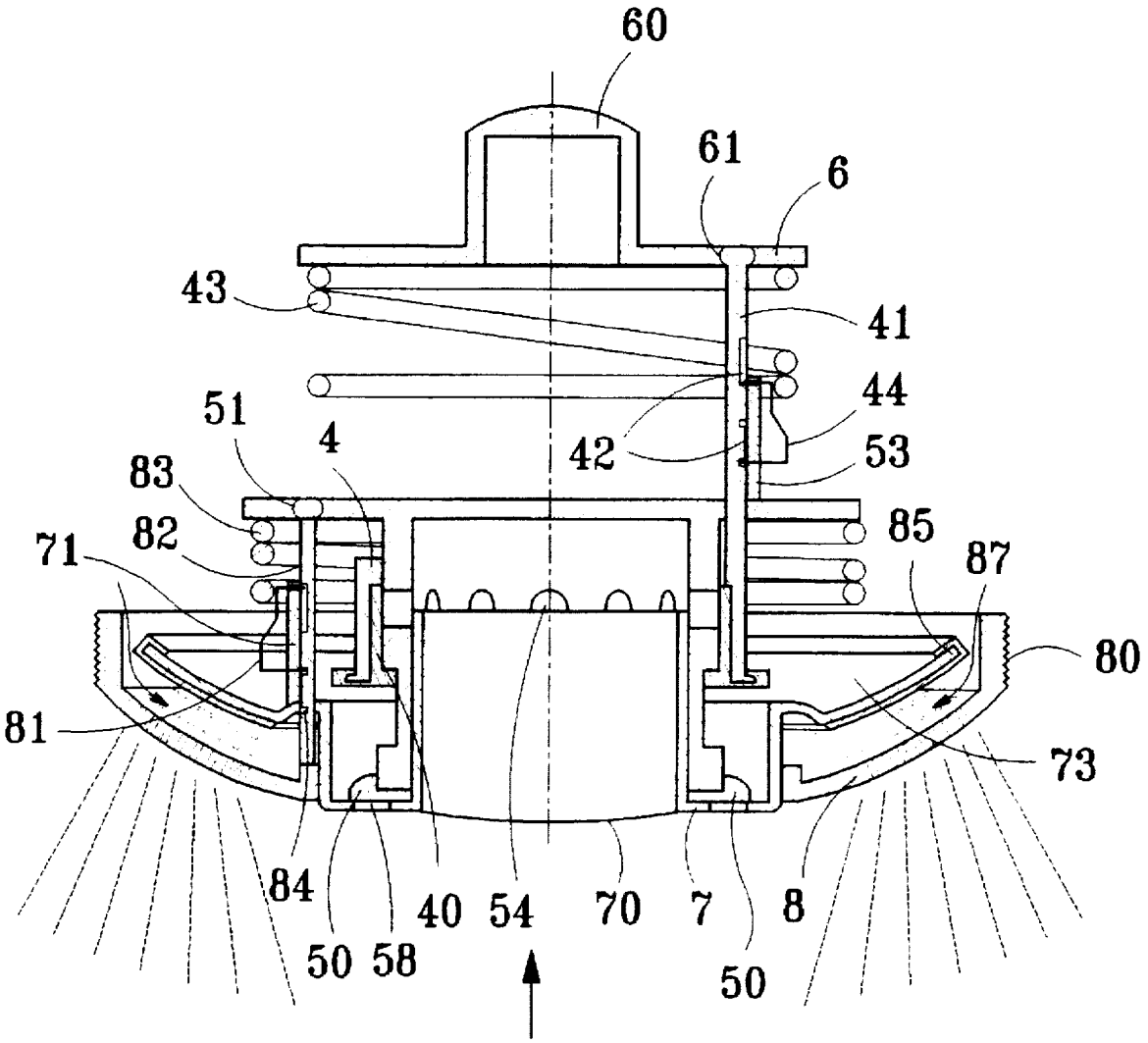
FIG. 9. is a spring valve means operation state for spraying.

Referring to FIG. 7 and 9, when at water spouting state, pressing the nozzle 7 repetitively, the nozzle spring 83 forces the nozzle hooks 81 to engage with the nozzle slots 84. Nozzle ring 73 and flush opening 58 move up or down together. The spray slot 87 and the flush opening 58 are opened or blocked by the spray cap washer 85 and the barrel washer 50. Water flows through spray slot 87 and spray cap 8 in spraying form.

While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A three-way adjustable shower device comprising:

a dual pipe elbow having two elbow inlets for hot water and cold water respectively, a shower head seat and an elbow outlet;

a hose means having a first dual flow passages inside for hot and cold water respectively and two ends, one end connecting with the elbow outlet of the dual pipe elbow, and another end connecting with a shower body; wherein the shower body has a shower arm with a second dual flow passage inside connecting at one end thereof with the first dual flow passages, an adjusting cell located at another end of the second dual flow passage having an adjusting opening on the top and an assembly cap screwed at the bottom thereof with a bulge formed on the top surface of the assembly cap, and a water collecting cell located inside a shower head extended beyond the shower arm; wherein the water collecting cell having a button hole on the top and a water outlet at the bottom thereof;

an adjusting valve located inside the adjusting cell above the assembly cap having a water passage inside, a pushing stud on the top accessible from the adjusting opening of the shower body for adjusting water temperature and flow rate; and a spring valve means including a spring cap, a nozzle, a retaining ring, a flush barrel, a push button flange, a pair of springs, four hooks and three washers; wherein the spring cap has screw threads on the outside rim and two symmetrical cap studs on the inside rim thereof with a nozzle slot adjacent each cap stud; the nozzle has two symmetrical nozzle studs and two nozzle apertures with a nozzle barrel located there between and a flow outlet at the bottom; the retaining ring has two symmetrical ring rods on the top rim with a ring slot adjacent each ring rod; the flush barrel has two symmetrical barrel apertures, two ring apertures two barrel studs, and a barrel neck having a plural number of barrel openings formed therein; the push button flange has two symmetrical button apertures and a push button head;

wherein the shower body may be operated by a user single handed for water flowing out in spouting, flushing or spraying fashion.

2. A three-way adjustable shower device of claim 1, wherein the two elbow inlets of the dual pipe elbow uses a pair of tightening rings to connect respectively with a hot water and a cold water pipe.

3. A three-way adjustable shower device of claim 1, wherein the hose means connects at one end with the elbow outlet of the dual pipe elbow by means of a twin hole plug, a connecting neck and a connecting sleeve, and connects at another end thereof with one end of the shower arm.

4. A three-way adjustable shower device of claim 1, wherein the adjusting valve is formed in substantially spherical shape capable of rotating in various directions to allow the water passage therein to connect with or move away from the first dual flow passage of the hose means so that different water flow rate and temperature may flow out of the adjusting valve.

5. A three-way adjustable shower device of claim 1, wherein the spring valve means is assembled as follows: the ring washer is located at the bottom of the retaining ring, the ring rod runs through a ring aperture of the flush barrel which is engaged with the retaining ring; a ring washer surrounds a barrel neck of the flush barrel, the ring spring surrounds a pair of barrel studs of the flush barrel, the ring rod engages with the button aperture of the push button flange, the barrel washer is disposed on an opening of the flush barrel which is inserted in the nozzle which has a spray cap washer disposed thereon, the cap rod runs through the barrel aperture and is disposed within the nozzle spring which also holds the nozzle stud so that the cap rod engages with a barrel aperture of the flush barrel; pressing the nozzle spring against the barrel aperture to engage a nozzle hook to engage with an aperture in the nozzle stud, once the nozzle slot is hooked the nozzle spring is released, the ring spring then compresses against the button aperture, upon the nozzle hook runs through an aperture of the barrel stud and engages with a ring slot, the ring spring is released; whereby upon repetitively pressing the push button head and the nozzle of the spring valve means, one of spouting, flushing and spraying water outflow fashions may be selected.

6. A three-way adjustable shower device of claim 1, wherein the adjusting cell further has a wheel valve cell which include two spindle slots, three wheel stoppers and two wheel valves located in two wheel cell openings;wherein each wheel valve has a water passage inside for connecting with or moving away from the dual flow passage to enable water flowing out at various temperatures and flow rate.

* * * * *